United States Patent [19]

Sims, Jr.

[11] 4,002,871

[45] Jan. 11, 1977

[54] COLUMN LEAF SPRING PUSH-BUTTON SWITCH FOR USE IN A KEYBOARD

[75] Inventor: Dewey M. Sims, Jr., Westland, Mich.

[73] Assignee: Burroughs Corporation, Detroit, Mich.

[22] Filed: Dec. 20, 1974

[21] Appl. No.: 534,825

[52] U.S. Cl. ..... 200/159 A; 200/67 DB; 200/288

[51] Int. Cl.[2] ..... H01H 3/12

[58] Field of Search ..... 200/159 R, 159 A, 159 B, 200/67 D, 67 DA, 67 DB, 288, 237–251, 164 R, 164 A, 165, 5 R, 5 A, 5 B, 5 C, 5 D, 5 E, 5 EA, 5 EB, 5 F, 153 L, 153 LA, 153 LB, 292, 283

[56] References Cited

UNITED STATES PATENTS

| | | | |
|---|---|---|---|
| 2,583,756 | 1/1952 | Wahlberg | 200/67 D |
| 2,923,787 | 2/1960 | Nelson | 200/67 DB |
| 3,161,751 | 12/1964 | Pusch et al. | 200/283 |

*Primary Examiner*—James R. Scott
*Assistant Examiner*—Morris Ginsburg
*Attorney, Agent, or Firm*—Manuel Quiogue; William B. Penn; Edwin W. Uren

[57] ABSTRACT

A push-button switch including a keytop plunger, a base structure for retaining and guiding the keytop plunger, a biasing contact member, and flexible wire contacts. The biasing contact member is a leaf spring mounted in the base structure and actuated into a bowed position by depression of the keytop plunger. The flexible wire contacts are also mounted in the base structure and are engaged by the leaf spring when it is bowed. The complete structure is mounted on a printed circuit board with the leaf spring and wire contacts connected to their respective contact leads on the PC board.

15 Claims, 5 Drawing Figures

COLUMN LEAF SPRING PUSH-BUTTON SWITCH FOR USE IN A KEYBOARD

BACKGROUND OF THE INVENTION

This invention generally relates to a manually actuated switching apparatus for engaging electrical contacts to complete an electrical conductive path. Specifically, the invention relates to a push-button switch for electrically completing an electrical circuit in a keyboard apparatus. The switch includes a spring member which serves as both a biasing means for the keytop plunger and as a contact means for completing an electrical conductive path.

Push-button switches have been previously incorporated in keyboards used for selectively interconnecting electrical circuits. For example, these switches may be used in the keyboard of an electronic calculator. However, prior art devices have certain disadvantages such as complexity due to a large number of parts and the resulting high production cost. Another disadvantage of prior art devices is the excessive amount of work required to depress the switches which resulted in finger fatigue for the user. The ambiguity of whether the keytop plunger has been depressed or whether the switch-make point had been achieved is another problem encountered in the prior art devices. Further disadvantages of the prior art include excessive contact bounce upon making contact and surface corrosion of the contacts.

The present invention is designed to overcome the disadvantages of the prior art devices by providing novel features which accomplish certain desired advantages.

It is therefore an object of this invention to provide a simple and low cost push-button switch which may be used in a keyboard.

It is a further object of this invention to provide an improved push-button switch having relatively few and simple parts.

Still another object is to provide a push-button switch wherein less work is required to press the keytop plunger to the switch-make point.

Another object of the invention is to provide a switch actuating mechanism having increased tactile feedback for definitely identifying depression of the keytop plunger and the switch-make point.

A further object of the invention is to provide a switching mechanism having improved electrical characteristics including minimal contact bounce and definite electrical contact between selectively contacting members.

An even further object of this invention is to reduce surface corrosion of contacts while providing a more reliable contact configuration.

SUMMARY OF THE INVENTION

The push-button switch of the present invention achieves the above objects by providing a column leaf spring which serves as both a biasing member and a contact member. The spring is secured at one end by a lower guide base which is mounted on a printed circuit board. The column leaf spring is appropriately connected to the desired contact leads on the printed circuit board. The other end of the column leaf spring is securely positioned against the underside of the keytop plunger. Contact wires are mounted in the lower guide base and extend through the P/C board to copper contacts on the other side of the board. The contact wires are positioned to allow the leaf spring to form a good bifurcated contact with the contact wires when the spring is bowed by depression of the keytop plunger. An arcuate surface is provided behind the wire contacts to provide a cantilevered surface against which the wire contacts are biased when engaged by the leaf spring. The leaf spring is mounted to assure bowing toward the wire contacts. When a flat leaf spring is used, relative positioning of the ends of the flat leaf spring and a supporting surface provide an initial bias for this purpose. A curved leaf spring with its convex side toward the wire contacts may be used without the supporting surface because the curved leaf spring will normally bow toward the wire contacts when thus mounted.

BRIEF DESCRIPTION OF THE DRAWING

The foregoing objects, features and advantages of the invention along with other objects and advantages which may be obtained by its use, will be apparent from the following detailed description when read in conjunction with the accompanying drawing wherein.

DETAILED DESCRIPTION OF THE PREFERRED EMBODIMENT

Figure 2:
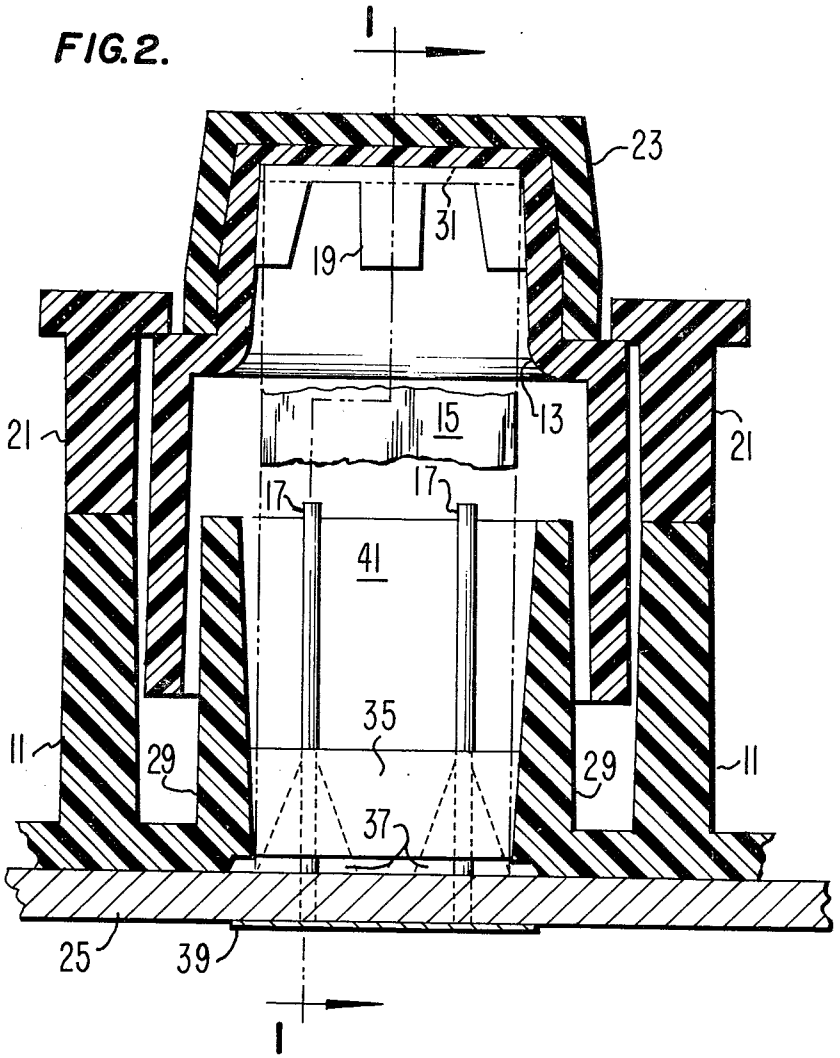
FIG. 2 is a cross-sectional view of the push-button switch showing the wire contacts of the present invention.

The push-button switch of the present invention includes a lower guide base 11 which serves as a vertical displacement guide for a keytop plunger 13 which is mounted within the push-button switch of the present invention. The lower guide base 11 also serves as the support system for a column leaf spring 15 and a set of wire contacts 17. The keytop plunger 13 includes a slotted wedge 19 formed on the underside of the keytop plunger 13 for maintaining the position of the upper end of the column leaf spring 15. An upper guide base 21 is mounted upon the lower guide base 11 and cooperates with the lower guide base 11 to form a guiding channel within which the keytop plunger 13 may be vertically displaced. The shoulder of the upper guide base 21 serves as an upper limit for the vertical displacement of the keytop plunger 13. Mounted on top of the keytop plunger 13 is a keytop 23. The complete push-button assembly is mounted on a printed circuit board 25 which has metal leads appropriately placed thereon.

The column leaf spring 15 has a lower angled section 27 securely mounted between the lower guide base 11 and the printed circuit board 25. A vertical supporting member 29 extends upward from the lower guide base 11 and surrounds the leaf spring 15 and the wire contacts 17. The upper end of the leaf spring 15 is maintained in a relatively fixed position with respect to the keytop plunger 13 by the angle of a corner 31 formed between the sloping edge of the slotted wedge 19 and the adjacent inner surface of the keytop plunger 13. A vertical supporting surface 33 on the inside of the vertical supporting member 29 cooperates with the corner 31 thus formed to place an initial bias on the leaf spring 15 by the relative positioning of the supporting surface 33 of the support member 29 and the corner 31. This initial bias is required to insure that the column leaf spring 15 will bow away from the supporting surface 33 and toward the wire contacts 17. The bias also maintains sufficient pressure on the keytop plunger 13 to prevent the keytop 23 from rattling in the upper guide base 21. As shown in FIG. 2, the width of the leaf spring 15 must be sufficient to contact both wire contacts 17 as explained hereinafter.

The wire contacts 17 are mounted in the printed circuit board 25 and extend through to the bottom side of the printed circuit board 25 for appropriate connection to metal leads on the bottom of the printed circuit board 25. The contact wires 17 are stabilized within the push-button assembly by the cooperation of the vertical supporting member 29 with an abutment member 35 which is formed as part of the lower guide base 11. Pyramid shaped cavities 37 are formed between the vertical supporting member 29 and the abutment member 35 for facilitating insertion of the wire contacts 17 into place. In the preferred embodiment, two wire contacts 17 are interconnected by a metal lead 39 on the bottom side of the printed circuit board 25 to insure good bifurcated connection between the leaf spring 15 and the wire contacts 17. The supporting member 29 has an arcuate surface 41 formed on the inside surface adjacent the wire contacts 17 against which the wire contacts 17 are bowed when engaged by the leaf spring 15.

Figure 1:
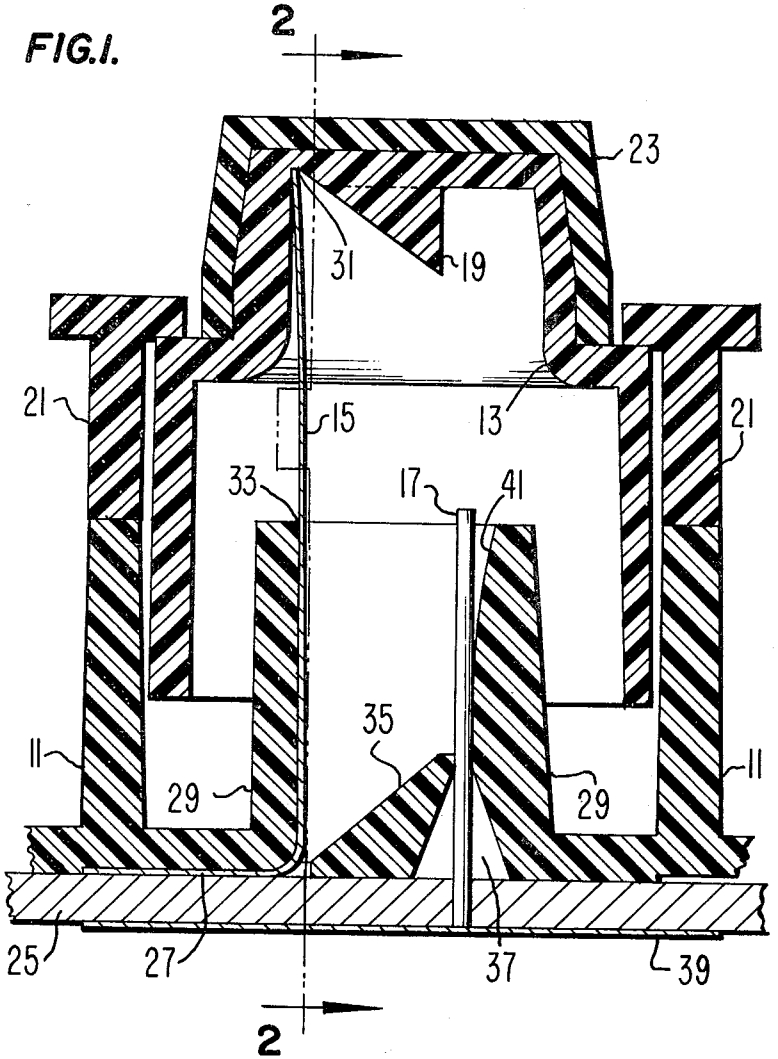
FIG. 1 is a cross-sectional view of the push-button switch showing a side view of the column leaf spring of the present invention.
Figure 3:
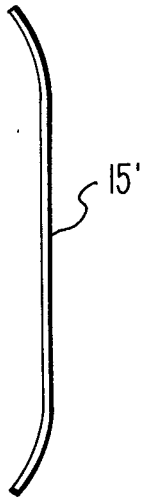
FIGS. 3 and 4 show end view of curved column leaf springs which may be used in the invention.
Figure 4:
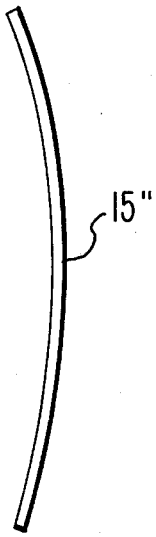
Figure 5:
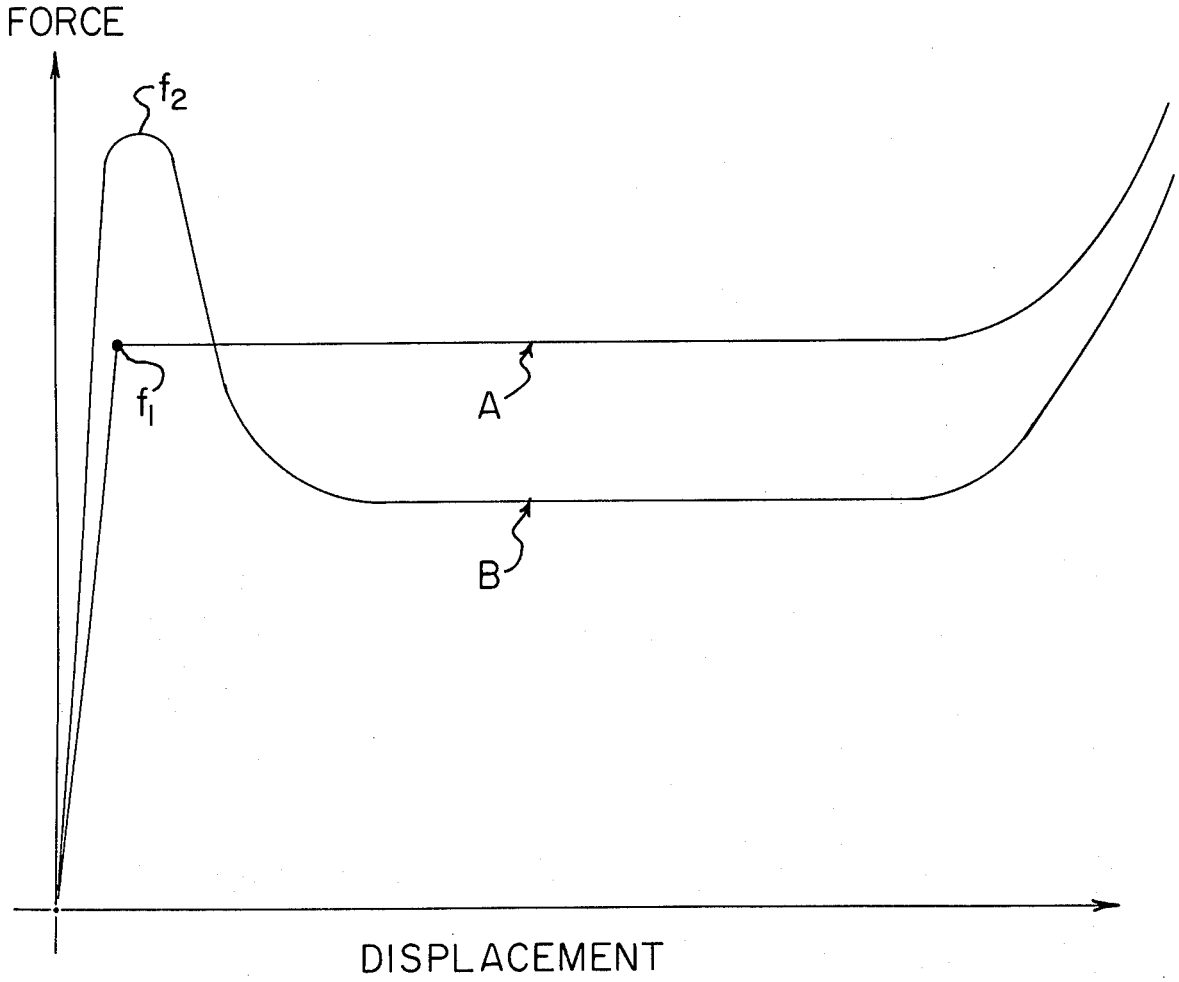
FIG. 5 is a graph of the force-displacement characteristics of the invention when used with a flat column leaf spring and a curved column leaf spring.

The operation of the push-button switch to be described hereafter will be best understood with reference to FIG. 5 which shows the force-displacement relationship for the push-button switch of the present invention. Curve A shows the relationship when a flat column leaf spring 15 is used as shown in FIG. 1. Curve B shows the relationship when curved leaf springs 15′, 15″ as shown in FIGS. 3 and 4, respectively, are used instead of the flat leaf spring 15. The following description assumes the use of the flat column leaf spring 15, but a curved column leaf spring 15′, 15″ operates in a similar manner as described hereafter.

Initiation of the operation of the push-button switch of the present invention requires an actuating force sufficient to overcome the critical buckling force of the leaf spring 15. This corresponds to point $f_1$ on Curve A. This critical buckling force is chosen to be sufficiently high to avoid accidental depression of the keytop 23. Continuous application of this same actuating force bows the column leaf spring 15 into a bifurcated contact with the wire contacts 17. Engagement of the wire contacts 17 by the column leaf spring 15 causes the wire contacts 17 to bend against the arcuate surface 41. Upon engagement of the wire contacts, a rapid increase in the force required to further displace the keytop plunger 13 is detected by the operator. This is shown on the right side of Curve A. This rapid increase identifies that the switch-make point has been attained.

The above-described structure accomplishes the desired electrical contact characteristics in the following manner. Contact bounce is almost totally eliminated because the leaf spring 15 is too structurally rigid when bowed to bounce off the wire contacts 17 when it comes into engagement with the wire contacts 17. As the wire contacts 17 are deflected by the leaf spring 15 against the arcuate surface 41, they become more rigid and thus any tendency to vibrate is rapidly diminished as the wire contacts 17 are pressed against the arcuate surface 41 when engaged by the bowing action of the leaf spring 15. Since the length of the contact wires 17 which is not in contact with the arcuate surface 41 is rapidly decreasing, any tendency to resonate is virtually eliminated. Improved electrical contact is achieved by the use of the multiple interconnected contact wires 17 as well as by the high contact force which is achieved with a relatively smaller amount of displacement force. The high contact force is a result of the geometrical relationship between the leaf spring 15 and the wire contacts 17. When the bowed leaf spring 15 deflects the wire contacts 17 against the arcuate surface 41, the opposing contact surfaces are curved and form substantially radial surfaces where the contact area is small and the resulting contact pressure is quite high. Additionally, there is some wiping action between the leaf spring 15 and the wire contacts 17 which keeps the contacting surfaces clean by removing possible surface corrosion, but the wiping action is not sufficient to cause undue wear. Furthermore, any surface corrosion removed by the wiping action of the leaf spring 15 against the wire contacts 17 will fall to a non-critical area between the abutment member 35 and the leaf spring 15 below the contact points.

FIGS. 3 and 4 are end views of curved leaf springs 15′, 15″ which may be used in place of the column leaf spring 15. The following description specifies the use of the curved leaf spring 15′, but is equally applicable to the use of the curved leaf spring 15″. The curved leaf spring 15′ is mounted in substantially the same manner as leaf spring 15 and has its convex side toward the wire contacts 17. In this configuration, the curvature of the cross section of the curved leaf spring 15′ allows it to bend only toward the wire contacts 17. Therefore, the supporting surface 33 is not required when the curved leaf spring 15′ is used because the cross sectional curvature performs the function of the initial bias placed on the leaf spring 15.

The curved leaf spring 15′ exhibits a different force displacement characteristic from that of the column leaf spring 15 and thus provides for tactile feedback indicating to the operator that the keytop 23 has been depressed. Curve B in FIG. 5 shows the force-displacement characteristic of the curved leaf spring 15′. The cross sectional curvature of curved leaf spring 15′ creates a more rigid column cross section modulus than exists in a flat leaf spring of the same thickness. This more rigid column exists when the curved leaf spring 15′ is in an unbowed configuration. Application of a sufficient force on the keytop 23 causes the curved leaf spring 15′ to buckle toward the wire contacts 17. After the initial buckling of the curved leaf spring 15′, the amount of force required to continue bowing is less than the force required to initially buckle the curved leaf spring 15′ because the section modulus is significantly changed as it is bowed and the column becomes less rigid. This reduced force required to continue bowing of the curved leaf spring 15′ is about the same as the force required to bow a flat leaf spring of the same thickness. It is therefore possible to use a thinner curved leaf spring 15′ to achieve a high critical buckling load to prevent accidental depression while providing a push-button switch which requires less work to operate because of the changes in the section modulus as the spring bows.

This advantage is shown by FIG. 5 wherein curve B is the force-displacement characteristic of the curved leaf spring 15′ which is thinner than the column leaf spring 15. The amount of force required to overcome the preload force is shown by point $f_2$ when the curved leaf spring 15′ buckles. Continuation of the bowing requires less force than the force required to continue bowing the column leaf spring 15 because the curved leaf spring 15′ is thinner. This rapid decrease in the force required to continue bowing the curved leaf spring 15′ provides the operator with tactile feedback. Engagement of the contact wires 17 causes a rapid increase in the force required to further displace the keytop 23 which identifies the switch-make point. The general reduction in the force required for displacement results in an overall reduction in the work required to depress the keytop plunger 13.

Another advantage of the curved leaf spring 15′ is that the curved leaf spring 15′ may be shorter than the column leaf spring 15 because high stress, which is proportional to thickness, limits how short either leaf spring may be. The curved leaf spring 15′ is a low stress design because it can be made thinner while providing a sufficient high critical buckling load to avoid accidental contact. Therefore, a lower profile may be achieved by the shorter curved leaf spring 15′.

From the foregoing it will be obvious to those skilled in the art that various modifications may be made within the spirit and scope of the present invention as defined by the appended claims.

What is claimed is:

1. A switching apparatus comprising:

resiliently deformable electrically conductive columnar means for resiliently deflecting into a bowed configuration upon actuation, said columnar means being capable of deflecting only in a lateral direction with respect to its undeflected configuration;

actuating means for causing said columnar means to be selectively and forcibly deflected into a bowed configuration;

elongated, resilient contact means parallely disposed with respect to said columnar means for engagement by said columnar means when said columnar means is forcibly actuated into a bowed configuration and for cooperating with said columnar means to complete a switching action; and elongated damping means substantially parallely disposed and adjacent to said elongated contact means to cooperate with said contact means when said contact means is forcibly engaged by said columnar means.

2. The switching apparatus of claim 1 wherein said resilient contact means comprises:

a plurality of resilient electrically conducting wires for engagement by said columnar means;

said damping means preventing vibration of said resilient wires when said resilient wires are engaged by said columnar means.

3. The switching apparatus of claim 2 wherein said damping means comprises an arcuate surface adjacent said resilient wires against which said resilient wires are pressed when engaged by said columnar means.

4. The switching apparatus of claim 3 wherein said columnar means comprises:

a column leaf spring fixed at one end and connected to said actuating means at the other end; and means for providing an initial bias on said column leaf spring toward said conducting wires.

5. The switching apparatus of claim 4 wherein said column leaf spring is configured to require application of a constant actuating force from said actuating means to initiate deflection into a bowed configuration and to continue deflection into engagement with said resilient wires.

6. The switching apparatus of claim 5 wherein said column leaf spring comprises a flat cross section.

7. The switching apparatus of claim 6 wherein said means for providing an initial bias comprises a supporting surface pressing against said column leaf spring to place a slight bow in said column leaf spring toward said resilient wires when said column leaf spring is not being deflected.

8. The switching apparatus of claim 7 wherein said actuating means comprises:

a manually depressable keytop plunger resting against the other end of said column leaf spring.

9. A switching apparatus comprising:

electrically conductive columnar means for resiliently deflecting into a bowed configuration upon sufficient axial loading, said columnar means requiring greater axial loading for initiation of deflection into a bowed configuration than for continuation of the deflection and being capable of deflecting only in a lateral direction with respect to its undeflected configuration;

means for axially loading said columnar means to cause said columnar means to be forcibly deflected into a bowed configuration;

elongated, resilient contact means parallely disposed with respect to said columnar means for engagement by said columnar means when said columnar means is forcibly deflected into a bowed configuration and for cooperating with said columnar means to complete a switching action; and elongated damping means substantially parallely disposed and adjacent to said elongated contact means to cooperate with said contact means when said contact means is forcibly engaged by said columnar means.

10. The switching apparatus of claim 9 wherein said resilient contact means comprises:

a plurality of resilient electrically conducting wires for engagement by said columnar means;

said damping means preventing vibration of said resilient wires when said resilient wires are being engaged by said columnar means.

11. The switching apparatus of claim 10 wherein said damping means comprises an arcuate surface adjacent said resilient wires against which said resilient wires are pressed when engaged by said columnar means.

12. The switching apparatus of claim 11 wherein said columnar means comprises:

a column leaf spring fixed at one end and connected to said means for axially loading at the other end, said leaf spring being configured to provide a greater resistance to being bowed when in a relaxed position than when axially loaded into a bowed position.

13. The switching apparatus of claim 12 wherein said column leaf spring comprises a curved cross section.

14. The switching apparatus of claim 13 wherein said means for axially loading comprises a keytop plunger in continuous engagement with the other end of said column leaf spring.

15. A switching apparatus for completing an electrically conductive path comprising:

a guide base having upper shoulders;

an electrically conductive column leaf spring mounted vertically within said guide base for deflection into a bowed configuration;

a plurality of contact wires parallely disposed with respect to said column leaf spring and engageable by said column leaf spring when said column leaf spring is forcibly deflected into a bowed configuration;

an arcuate surface substantially parallely disposed and adjacent to said contact wires against which said contact wires are biased when engaged by said column leaf spring, said arcuate surface preventing vibration of said contact wires when said contact wires are engaged by said column leaf spring; and a keytop plunger resting within said guide base and being confined by the upper shoulders of said guide base, said plunger being in continuous engagement with said column leaf spring for deflecting said column leaf spring into a bowed configuration.

* * * * *